US008662841B2

(12) United States Patent
Tollner et al.

(10) Patent No.: US 8,662,841 B2
(45) Date of Patent: Mar. 4, 2014

(54) VACUUM PUMP

(75) Inventors: Martin Ernst Tollner, Eastbourne (GB); Barrie Dudley Brewster, Brighton (GB)

(73) Assignee: Edwards Limited, West Sussex (GB)

( * ) Notice: Subject to any disclaimer, the term of this patent is extended or adjusted under 35 U.S.C. 154(b) by 1041 days.

(21) Appl. No.: 12/311,233

(22) PCT Filed: Jul. 27, 2007

(86) PCT No.: PCT/GB2007/050452

§ 371 (c)(1), (2), (4) Date: Dec. 1, 2009

(87) PCT Pub. No.: WO2008/035113

PCT Pub. Date: Mar. 27, 2008

(65) Prior Publication Data

US 2010/0068054 A1 Mar. 18, 2010

(30) Foreign Application Priority Data

Sep. 22, 2006 (GB) ..... 0618745.4
Jan. 11, 2007 (GB) ..... 0700512.7

(51) Int. Cl.
*F01D 25/16* (2006.01)

(52) U.S. Cl.
USPC ..... 415/229

(58) Field of Classification Search
USPC ..... 415/229
See application file for complete search history.

(56) References Cited

U.S. PATENT DOCUMENTS 2,954,157 A 9/1960 Eckberg
3,759,626 A * 9/1973 Becker ..... 415/90
3,950,964 A * 4/1976 Alexeeva et al. ..... 464/78
4,127,286 A * 11/1978 Albertsen ..... 285/41
4,872,767 A * 10/1989 Knapp ..... 384/99

(Continued)

FOREIGN PATENT DOCUMENTS

CN 1074985 A 8/1993
DE 2 249 985 4/1974

(Continued)

OTHER PUBLICATIONS

United Kingdom Search Report of Application No. GB 0700512.7 mailed May 24, 2007; Claims searched: 1-16; Date of search: May 23, 2007.

(Continued)

*Primary Examiner* — Edward Look
*Assistant Examiner* — Aaron R Eastman
(74) *Attorney, Agent, or Firm* — Westman, Champlin & Koehler, P.A.

(57) ABSTRACT

A vacuum pump comprises a housing, a drive shaft supported by a beating arrangement for rotation relative to the housing about an axis, and a pumping mechanism comprising a stator component mounted on the housing and a disk-shaped rotor component mounted on the drive shaft axially proximate the stator component. The bearing arrangement comprises a bearing supported in both radial and axial directions by a resilient support, comprising inner and outer annular portions connected by a plurality of flexible members, so that there is a fixed relation between the inner race of the bearing and the outer portion of the resilient support to determine the axial clearance between the rotor and stator components of the pumping mechanism.

13 Claims, 3 Drawing Sheets

(56) References Cited

U.S. PATENT DOCUMENTS

| | | | | |
|---|---|---|---|---|
| 5,547,338 | A | 8/1996 | Conrad et al. | |
| 5,603,574 | A * | 2/1997 | Ide et al. | 384/117 |
| 5,803,612 | A * | 9/1998 | Battig | 384/99 |
| 6,585,480 | B2 | 7/2003 | Kawasaki et al. | |
| 6,641,376 | B1 | 11/2003 | Englander | |
| 2003/0223859 | A1 | 12/2003 | Carboneri et al. | |
| 2004/0013514 | A1 * | 1/2004 | Englander | 415/90 |
| 2006/0018774 | A1 * | 1/2006 | Casaro | 417/423.12 |
| 2008/0138202 | A1 * | 6/2008 | Eilers et al. | 415/229 |
| 2010/0104428 | A1 | 4/2010 | Tollner et al. | |
| 2010/0215475 | A1 * | 8/2010 | Brewster et al. | 415/90 |

FOREIGN PATENT DOCUMENTS

| | | | |
|---|---|---|---|
| DE | 25 02 323 | A1 | 7/1975 |
| DE | 4314418 | A1 | 11/1994 |
| DE | 4410656 | A1 | 9/1995 |
| DE | 197 09 205 | A1 | 9/1998 |
| EP | 0874159 | A2 | 10/1998 |
| EP | 1170508 | A1 | 1/2002 |
| FR | 2 820 178 | | 8/2002 |
| GB | 317660 | | 8/1929 |
| JP | S62258186 | A | 11/1987 |
| JP | S6321394 | A | 1/1988 |
| JP | H08511071 | A | 11/1996 |
| JP | 2003214378 | A | 7/2003 |
| WO | 0129417 | A1 | 4/2001 |
| WO | WO 2004/097224 | A1 | 11/2004 |
| WO | WO 2004/099622 | A1 | 11/2004 |
| WO | WO 2006/131694 | A1 | 12/2006 |

OTHER PUBLICATIONS

PCT Notification of Transmittal of the International Search Report and the Written Opinion of the International Searching Authority, or the Declaration of International Application No. PCT/GB2007/050452; Date of mailing: Nov. 9, 2007.

PCT International Search Report of International Application No. PCT/GB2007/050452; Date of mailing of the International Search Report: Nov. 9, 2007.

PCT Written Opinion of the International Searching Authority of International Application No. PCT/GB2007/050452; Date of mailing: Nov. 9, 2007.

Tu et al., Journal of Vacuum Science & Technology, "A New Design for the Disk-Type Molecular Pump", vol. 8, No. 5, pp. 3870-3873, May 1990.

United Kingdom Search Report dated Jan. 4, 2007 for corresponding Application No. GB0618745.4.

Prosecution history from corresponding Canadian Application No. 2,662,668 including: Office Action dated Nov. 17, 2010; Response dated May 13, 2011.

Prosecution history from corresponding Canadian Application No. 2,662,670 including: Office Action dated Aug. 21, 2013.

Prosecution history from corresponding Chinese Application No. 200780034974 including: First Office Action dated Aug. 30, 2010; Second Office Action dated Jan. 21, 2012; Third Office Action dated Oct. 31, 2012.

Prosecution history from corresponding Chinese Application No. 200780035047 including: Second Office Action dated Oct. 11, 2010; Telephone Interview dated Jan. 5, 2011; First Office Action dated Apr. 13, 2010; Response dated Jan. 5, 2011.

Prosecution history from corresponding European Application No. 07766464.7 including: Communication dated Jul. 12, 2012; Response dated Nov. 15, 2012.

Prosecution history from corresponding European Application No. 07789351.9 including: Response dated Mar. 18, 2011.

Prosecution history from corresponding Japanese Application No. 2009-528793 including: Office Action dated Feb. 6, 2013; Notification of Reason for Rejection dated May 28, 2012.

Prosecution history from corresponding Japanese Application No. 2009-528794 including: Office Action dated Jun. 29, 2012.

Prosecution history from corresponding Taiwanese Application No. 096129244 including: Office Action dated Nov. 28, 2012; Search Report dated Nov. 12, 2012.

* cited by examiner

VACUUM PUMP

FIELD OF THE INVENTION

The present invention relates to a vacuum pump, and finds particular, but not exclusive, use in a vacuum pump comprising a molecular drag pumping mechanism.

BACKGROUND OF THE INVENTION

Molecular drag pumping mechanisms operate on the general principle that, at low pressures, gas molecules striking a fast moving surface can be given a velocity component from the moving surface. As a result, the molecules tend to take up the same direction of motion as the surface against which they strike, which urges the molecules through the pump and produces a relatively higher pressure in the vicinity of the pump exhaust.

These pumping mechanisms generally comprise a rotor and a stator provided with one or more helical or spiral channels opposing the rotor. Types of molecular drag pumping mechanisms include a Holweck pumping mechanism comprising two co-axial cylinders of different diameters defining a helical gas path therebetween by means of a helical thread located on either the inner surface of the outer cylinder or on the outer surface of the inner cylinder, and a Siegbahn pumping mechanism comprising a rotating disk opposing a disk-like stator defining spiral channels that extend from the outer periphery of the stator towards the centre of the stator. Another example of a molecular drag pumping mechanism is a Gaede mechanism, whereby gas is pumped around concentric channels arranged in either a radial or axial plane. In this case, gas is transferred from stage to stage by means of crossing points between the channels and tight clearance 'stripper' segments between the adjacent inlet and outlet of each stage. Siegbahn and Holweck pumping mechanisms do not require crossing points or tight clearance 'stripper' segments because their inlets and outlets are disposed along the channel length.

For manufacturing purposes a Siegbahn pumping mechanism may be preferred to the Holweck and Gaede pumping mechanisms. However, for a given rotor-to-stator clearance, a Siegbahn pumping mechanism typically requires more pumping stages to achieve the same levels of compression and pumping speed as a Holweck pumping mechanism. Furthermore, a Siegbahn pumping mechanism requires tight clearances to be achieved in an axial direction, otherwise more pumping stages—and thus greater power consumption—will be required to achieve the required level of pumping performance. Achieving tight axial clearances between the rotor and stator components of a Siegbahn pumping mechanism can be relatively difficult and/or costly. For example, U.S. Pat. No. 6,585,480 describes a vacuum pump comprising a drive shaft having a plurality of rotor disks of a Siegbahn pumping mechanism mounted along the length of the shaft. Stator disks extend radially inwardly from the stator of the vacuum pump and are located between the rotor disks. A relatively complex and expensive magnetic bearing arrangement comprising upper and lower radial magnetic bearings, and an axial magnetic bearing, is provided for supporting the drive shaft out of contact with the stator, and for maintaining the required axial clearances between the rotor and stator disks.

SUMMARY OF THE INVENTION

The present invention provides a vacuum pump comprising a housing, a drive shaft supported by a bearing arrangement for rotation relative to the housing, and a pumping mechanism comprising a stator component mounted on the housing and a rotor component mounted on the drive shaft axially proximate the stator component, the bearing arrangement comprising a bearing supported in both radial and axial directions by a metallic resilient support, comprising inner and outer annular portions connected by a plurality of flexible members, so that there is a fixed relation between the inner race of the bearing and the outer portion of the resilient support to determine the axial clearance between the rotor and stator components of the pumping mechanism.

BRIEF DESCRIPTION OF THE DRAWINGS

Preferred features of the present invention will now be described, by way of example only, with reference to the accompanying drawings, in which.

DETAILED DESCRIPTION OF THE INVENTION

Figure 1:
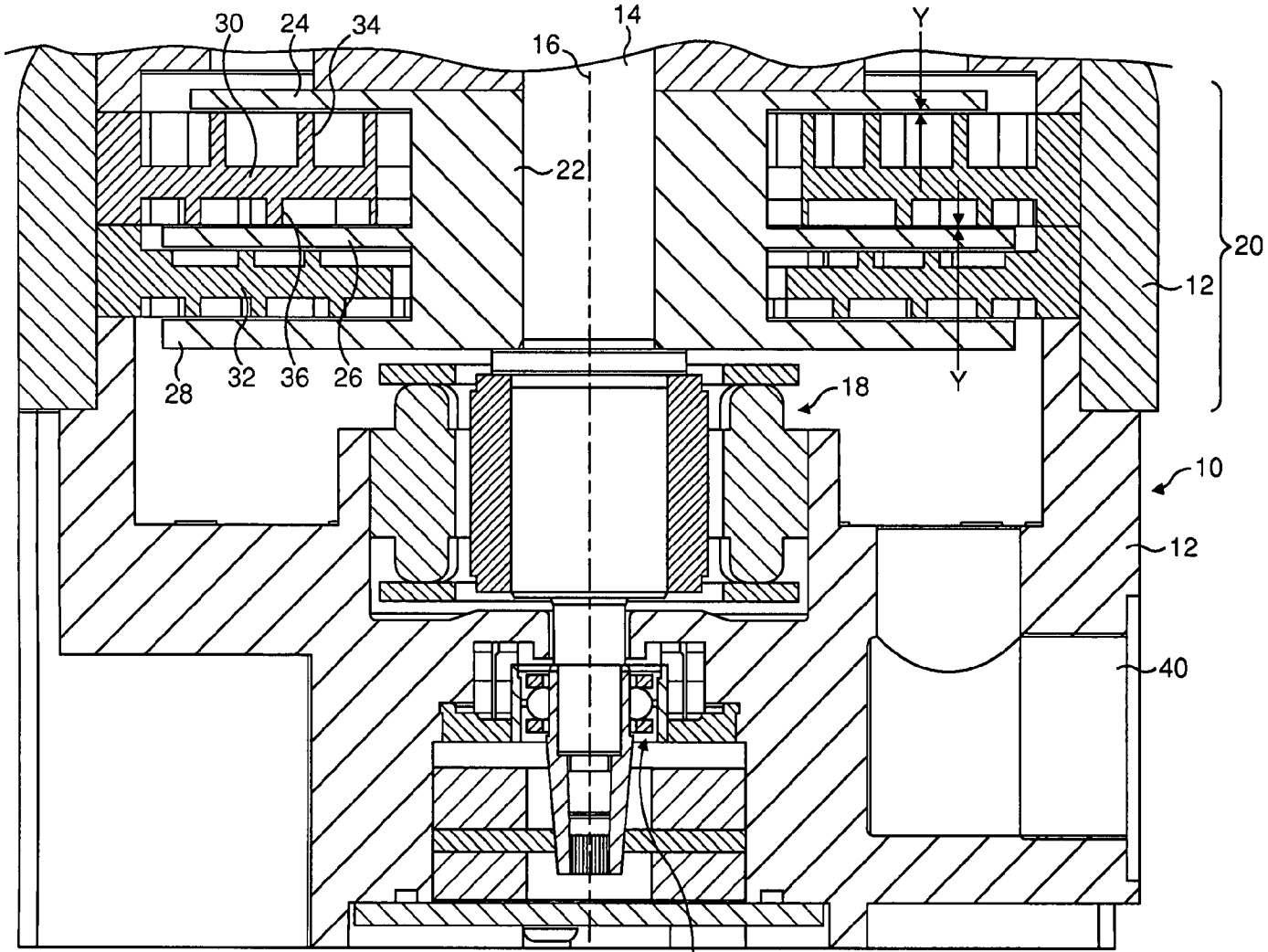
FIG. 1 is a cross-sectional view of part of a vacuum pump.

The present invention provides a vacuum pump comprising a housing, a drive shaft supported by a bearing arrangement for rotation relative to the housing, and a pumping mechanism comprising a stator component mounted on the housing and a rotor component mounted on the drive shaft axially proximate the stator component, the bearing arrangement comprising a bearing supported in both radial and axial directions by a metallic resilient support, comprising inner and outer annular portions connected by a plurality of flexible members, so that there is a fixed relation between the inner race of the bearing and the outer portion of the resilient support to determine the axial clearance between the rotor and stator components of the pumping mechanism.

The use of a resilient support for both supporting the drive shaft in the axial and radial directions, and for determining the axial clearance between the rotor and stator components of the pumping mechanism, can significantly reduce the cost and complexity of the prior bearing arrangement of axial and radial magnetic bearings whilst enabling tight tolerance control of the axial position of the bearing in the resilient support, and thus tight control of the axial clearance between the components of the pumping mechanism, to be achieved.

Each of the flexible members is preferably an elongate, arcuate member substantially concentric with the inner and outer annular portions. In the preferred embodiment, these members are circumferentially aligned. The flexible members of the resilient support can thus provide integral leaf springs of the resilient support, and hence determine the radial stiffness of the resilient support. The radial flexibility of the resilient support may be readily designed, for example using finite element analysis, to have predetermined flexure characteristics adapted to the vibrational characteristics of the drive shaft. Low radial stiffness in the range from 50 to 500 N/mm may be achieved to meet the required rotor dynamics of the vacuum pump; lowering the radial stiffness reduces the second mode natural frequency of the pump, which in turn reduces the transmissibility of vibration at full pump speed and hence the level of pump vibration for a specific shaft out-of-balance. In view of this, acceptable levels of transmission imbalance vibration may be achieved without the need to perform high speed balancing, providing a significant cost reduction per pump.

The flexible members may be axially displaced to axially preload the bearing.

The resilient support is preferably formed from metallic material such as tempered steel, aluminium, titanium, phosphor bronze, beryllium copper, an alloy of aluminium or an alloy of titanium. In this case, the radial and axial stiffnesses of the resilient support do not change with temperature or with time, that is, through creep. The axial stiffness of the resilient support is preferably in the range from 500 to 10,000 N/mm, more preferably in the range from 500 to 1,000N/mm and most preferably in the range from 600 to 800 N/mm, so that there is minimal axial movement of the drive shaft during operation of the pump, thus enabling the tight axial clearance between the components of the pumping mechanism to be substantially maintained during operation of the pump.

At least one elastomeric damping member is preferably mounted on the resilient support for damping radial vibrations. The damping member may be conveniently located within an annular groove formed in an end surface of the resilient support.

The pumping mechanism may be a Siegbahn pumping mechanism, with one of the rotor and the stator components comprising a plurality of walls having side surfaces extending towards the other of the rotor and the stator components and defining a plurality of spiral channels. Alternatively, the pumping mechanism may be a Gaede pumping mechanism, or a regenerative pumping mechanism.

The pumping mechanism may comprise a plurality of said rotor components located on the drive shaft and a plurality of said stator components mounted on the housing and located between the rotor components.

A turbomolecular pumping mechanism may be provided upstream from the pumping mechanism.

With reference first to FIG. 1, a vacuum pump 10 comprises a housing 12 and a drive shaft 14 supported by a bearing arrangement for rotation relative to the housing 12 about longitudinal axis 16. A motor 18 is located in the housing 12 for rotating the drive shaft 14. The vacuum pump 10 also comprises at least pumping mechanism 20, which in this example is provided by a Siegbahn pumping mechanism, although the pumping mechanism may comprise one or more of a Siegbahn pumping mechanism, a Gaede pumping mechanism and a regenerative pumping mechanism. A turbomolecular pumping mechanism (not shown) may be provided upstream from the pumping mechanism 20.

The Siegbahn pumping mechanism illustrated in FIG. 1 comprises an impeller 22 mounted on the drive shaft 14 for rotation therewith. The impeller 22 comprises a plurality of rotor components 24, 26, 28 of the Siegbahn pumping mechanism, which are in the form of planar, disk-like members extending outwardly from the drive shaft 12, substantially orthogonal to the axis 16. A plurality of stator components of the Siegbahn pumping mechanism are mounted on the housing 12 and located proximate to and between the rotor components. In this example, the Siegbahn pumping mechanism comprises three rotor components 24, 26, 28 and two stator components 30, 32, although any number of rotor components and stator components may be provided as necessary in order to meet the required pumping performance of the vacuum pump.

Each stator component 30, 32 is in the form of an annular stator component, and comprises a plurality of walls that extend towards an adjacent rotor component. For example, with reference to stator component 30, the stator component 30 comprises a plurality of walls 34, 36 located on each respective side thereof. The walls 34 extend towards rotor component 24, and define a plurality of spiral flow channels on one side of the stator component. The walls 36 extend towards rotor component 26, and define a plurality of spiral flow channels on the other side of the stator component. Stator component 32 is configured in a similar manner to stator component 30. The height of the walls of the stator components 30, 32 decreases axially along the Siegbahn pumping mechanism so that the volumes of the flow channels gradually decrease towards the outlet 40 of the vacuum pump 10 to compress gas passing through the pumping mechanism 20. The end of each wall is spaced from the opposing surface of the adjacent rotor component by an axial clearance y, which is indicated in FIG. 1.

The shaft 14 is supported by a bearing arrangement comprising two bearings which may be positioned either at respective ends of the shaft or, alternatively, intermediate the ends. A passive magnetic bearing (not shown) supports a first, high vacuum portion of the shaft 14. The use of a magnetic bearing to support the high vacuum portion of the shaft 14 is preferred as it requires no lubricant, which could otherwise contaminate the pumping mechanism. As a passive magnetic bearing is axially unstable, and is unable to provide positive axial location for the shaft 14, a rolling bearing 42 supports a second, low vacuum portion of the shaft 14 to counteract this axial instability and to provide positive axial location of the shaft 14.

Figure 2:
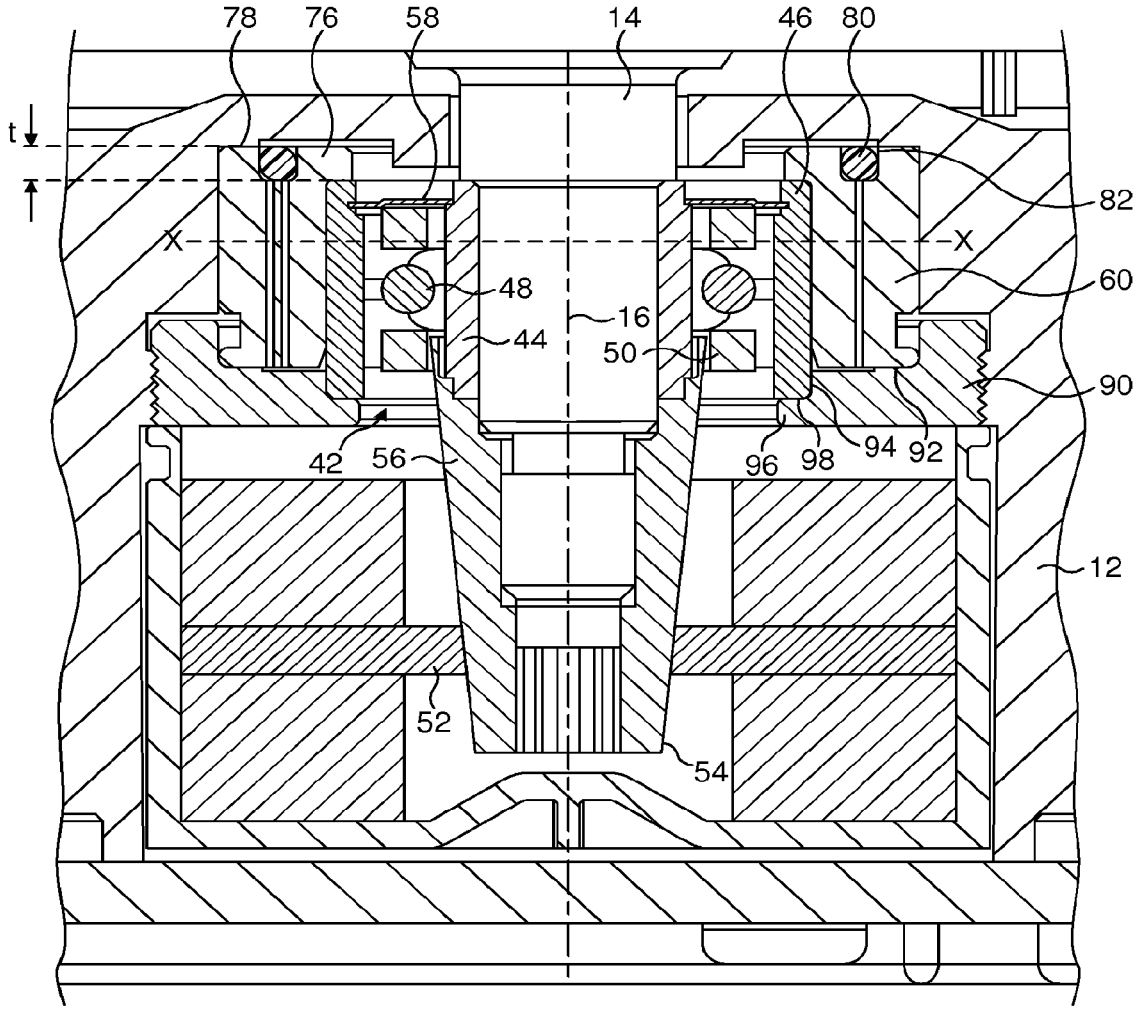
FIG. 2 is a close-up of part of FIG. 1.

The rolling bearing 42 is illustrated in more detail in FIG. 2. The rolling bearing 42 is located between the low vacuum portion of the shaft 14 and the housing 12 of the pump 10. The rolling bearing 42 comprises an inner race 44 fixed relative to the shaft 14, an outer race 46, and a plurality of rolling elements 48, supported by a cage 50, for allowing relative rotation of the inner race 44 and the outer race 46. The rolling bearing 42 is lubricated using a lubricant such as oil to establish a load-carrying film separating the bearing components in rolling and sliding contact in order to minimize friction and wear. In this example, the lubricant supply system comprises a centrifugal pump including one or more wicks 52 for supplying lubricant from a lubricant reservoir of the pump 10 to the tapered surface 54 of a conical nut 56 located on one end of the shaft 14. With rotation of the shaft 14, the lubricant travels along the tapered surface 54 into the lower (as illustrated) end of the bearing 42. Shield elements 58 may be provided to resist seepage of lubricant from the bearing 42. The shield may be a separate component, held in place by a spring clip or other fastener, or may be an integral part of the outer race 46. Alternatively, the bearing 42 may be lubricated using grease (a mixture of oil and a thickening agent) so that the pump 10 may be used in any orientation.

Figure 3:
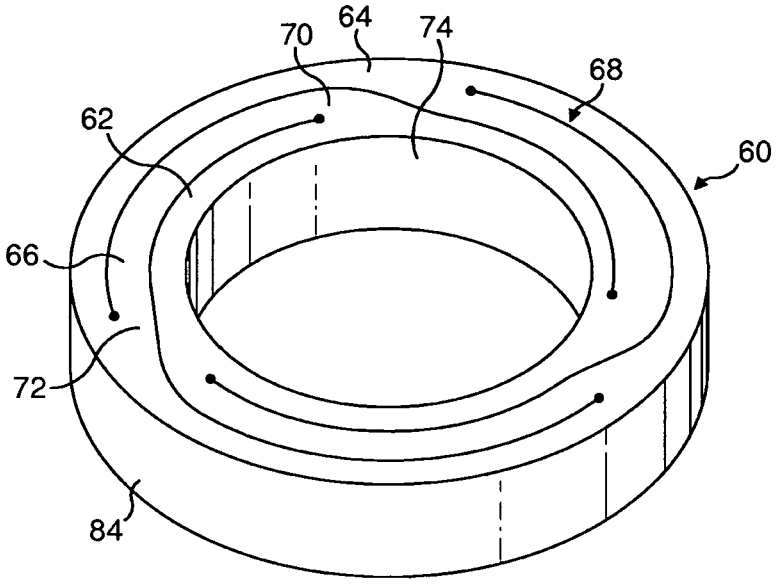
FIG. 3 is a perspective view of a section of the resilient support taken through line X-X in FIG. 2.

In order to provide damping of vibrations of the shaft 14 and bearing 42 during use of the pump 10, a resilient support 60 is provided between the bearing 42 and the housing 12 for supporting the bearing 42 in both radial and axial directions relative to the housing 12. As illustrated in FIG. 3, the resilient support 60 comprises a metallic member having integral inner and outer annular portions 62, 64 connected together by a plurality of integral flexible members 66 formed by machining slots 68 in the support 60. Each flexible member 66 is connected by a first resilient hinge 70 to the inner portion 62, and by a second resilient hinge 72 to the outer portion 64.

Each flexible member 66 is in the form of an elongate, arcuate member substantially concentric with the inner and outer annular portions 62, 64, and, as illustrated in FIG. 3, the flexible members 66 are preferably circumferentially aligned. The flexible members 66 of the resilient support 60 thus provide integral leaf springs of the resilient support 60.

The inner portion 62 of the resilient support 60 has an inner, axially extending cylindrical surface 74 engaging the outer surface of the outer race 46 of the rolling bearing 42. As illustrated in FIG. 2, the inner portion 62 also has a radially inward extending axial support portion 76 located towards the upper (as illustrated) end surface 78 thereof for engaging the upper surface of the outer race 46 of the rolling bearing 42 to axially support the bearing 42 so that there is a fixed relation between the inner race 44 of the bearing 42 and the outer portion 64 of the resilient support 60. The axial support portion 76 has a thickness t in the axial direction, that is, in a direction parallel to longitudinal axis 16 of the shaft 14. An elastomeric damping ring 80 is located in an annular groove 82 formed in the end surface 78 of the resilient support 60. The damping ring 80 is designed to have a relatively loose radial fit within the grooves 82.

The end surface 78 engages a radially extending surface of the housing 12, whilst the outer, axially extending cylindrical surface 84 of the outer portion 64 of the resilient support 60 engages an axially extending surface of the housing 12. A bearing nut 90 is attached to the housing 12 by means of mutually-engaging screw threads such that an upper (as illustrated) end surface of the bearing nut 90 engages the lower end surface 92 of the resilient support 60 to retain the resilient support 60 relative to the housing 12, and to preferably axially pre-load the resilient support 60. As illustrated in FIG. 2, the bearing nut 90 has an inner axially extending surface 94 which provides a radial end stop surface for limiting radial movement of the shaft 14 and bearing 42. The bearing nut 90 also has a radially inward extending portion 96 having an upper (as illustrated) surface 98 to provide an axial end stop surface for limiting axial movement of the shaft 14 and bearing 42 in the downward (as illustrated) direction. The housing 12 provides an opposing axial end stop surface for limiting axial movement of the shaft 14 and bearing 42 in the upward (as illustrated) direction.

The resilient support 60 is formed from metallic material such as aluminium or an alloy thereof, tempered steel, beryllium copper, phosphor bronze, titanium or an alloy thereof, or other metallic alloy. The stiffness of the resilient support 60 is determined by the geometry of the slots 68, and thus the geometry of the flexible members 66, and can be accurately estimated using finite element analysis. We have found that the resilient support 60 can be readily designed to have a relatively low radial stiffness, for example in the range from 50 to 500 N/mm, and preferably around 200 N/mm, for inhibiting the transmission of vibrations from the shaft 14 to the housing 12. In the event that there are relatively large radial displacements of the rotor 14 and bearing 42 during use of the pump 10, for example, due to a relatively high imbalance or when running at or around critical speeds, the damping ring 80 is radially compressed, resulting in radial damping of the vibrations. When the vibrations are relatively small, little radial damping is produced by the damping ring 80, and so there is little transmission of the vibrations to the housing 12.

The resilient support 60 may also have a relatively high axial stiffness, for example in the range from 500 to 10,000 N/mm, preferably in the range from 500 to 1000 N/mm and more preferably in the range from 600 to 800 N/mm, so that there is minimal axial movement of the shaft 14 during operation of the pump 10. In this example, the thickness t of the axial support portion 76 of the resilient support 60 determines the spatial relationship between the inner race of the bearing 42 and the outer portion of the resilient support, which in turn determines the axial clearance y between the rotor and stator components of the pumping mechanism 20. Due to the high axial stiffness of the resilient support 60, this axial clearance may be maintained at a substantially constant value during the use of the pump 10, thereby enabling a tight axial clearance to be maintained during use of the pump 10.

While the foregoing description and drawings represent various embodiments of the present invention, it will be apparent to those skilled in the art that various changes and modifications may be made therein without departing from the true spirit and scope of the present invention.

We claim:

1. A vacuum pump comprising a housing, a drive shaft supported by a bearing arrangement for rotation relative to the housing, and a pumping mechanism comprising a stator component mounted on the housing and a rotor component mounted on the drive shaft axially proximate the stator component, the bearing arrangement comprising a bearing supported in both radial and axial directions by a metallic resilient support, comprising inner and outer annular portions connected by a plurality of flexible members, wherein the inner annular portion comprises a radially inward extending axial support portion having a thickness and contacting a surface of the bearing such that the thickness determines the axial clearance between the rotor and stator components of the pumping mechanism.

2. The vacuum pump according to claim 1 wherein each of the flexible members is an elongate, arcuate member concentric with the inner and outer annular portions.

3. The vacuum pump according to claim 2 wherein the flexible members are circumferentially aligned.

4. The vacuum pump according to claim 1 wherein the flexible members provide a plurality of integral leaf springs of the resilient support.

5. The vacuum pump according to claim 1 wherein the flexible members are axially displaced to axially preload the bearing.

6. The vacuum pump according to claim 1 wherein the metallic resilent support comprises a metallic comprising a metal selected from the group of metals consisting of tempered steel, aluminium, titanium, phosphor bronze, beryllium copper, an alloy of aluminium and an alloy of titanium.

7. The vacuum pump according to claim 6 wherein the resilient support has an axial stiffness in the range from 500 to 1000 N/mm.

8. The vacuum pump according to claim 1 wherein the resilient support has an axial stiffness in the range from 500 to 10,000 N/mm.

9. The vacuum pump according to claim 1 wherein the resilient support has a radial stiffness in the range from 50 to 500 N/mm.

10. The vacuum pump according to claim 1 wherein an elastomeric damping member is mounted on the resilient support.

11. The vacuum pump according to claim 10 wherein the damping member is located within an annular groove formed in an end surface of the resilient support.

12. The vacuum pump according to claim 1, wherein one of the rotor and the stator components comprises a plurality of walls having side surfaces extending towards the other of the rotor and the stator components and defining a plurality of spiral channels.

13. The vacuum pump according to claim 1 wherein the pumping mechanism comprises a plurality of rotor components located on the drive shaft and a plurality of stator components mounted on the housing and located between the rotor components.

* * * * *

UNITED STATES PATENT AND TRADEMARK OFFICE

CERTIFICATE OF CORRECTION

PATENT NO. : 8,662,841 B2
APPLICATION NO. : 12/311233
DATED : March 4, 2014
INVENTOR(S) : Martin Ernst Tollner et al.

It is certified that error appears in the above-identified patent and that said Letters Patent is hereby corrected as shown below:

On the Title Page

In the Abstract Item (57), line 2, please delete "beating" and replace with --bearing--.

Signed and Sealed this
Fifteenth Day of July, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,662,841 B2
APPLICATION NO. : 12/311233
DATED : March 4, 2014
INVENTOR(S) : Tollner et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1298 days.

Signed and Sealed this
Twenty-ninth Day of September, 2015

Michelle K. Lee

Michelle K. Lee
*Director of the United States Patent and Trademark Office*